United States Patent [19]

Steigerwald et al.

[11] Patent Number: 4,669,621

[45] Date of Patent: Jun. 2, 1987

[54] BOTTLE WITH SUPPORTING CLOSURE

[75] Inventors: Franz Steigerwald, Griesheim; Franz Adler, Stockstadt, both of Fed. Rep. of Germany

[73] Assignee: Wella Aktiengesellschaft, Darmstadt, Fed. Rep. of Germany

[21] Appl. No.: 840,571

[22] PCT Filed: Jan. 12, 1985

[86] PCT No.: PCT/EP85/00008

§ 371 Date: Jan. 17, 1986

§ 102(e) Date: Jan. 17, 1986

[87] PCT Pub. No.: WO85/05342

PCT Pub. Date: Dec. 5, 1985

[30] Foreign Application Priority Data

May 18, 1984 [DE] Fed. Rep. of Germany ..... 3418540

[51] Int. Cl.[4] ..... B65D 51/24

[52] U.S. Cl. ..... 215/228; 215/334; 215/100 R

[58] Field of Search ..... 215/228, 334, 100 R

[56] References Cited

U.S. PATENT DOCUMENTS

| | | | |
|---|---|---|---|
| 2,804,203 | 8/1957 | Harkness et al. | 215/228 X |
| 3,099,452 | 7/1963 | Fernicola | 215/228 X |
| 3,402,844 | 9/1968 | Chin | 215/228 X |

FOREIGN PATENT DOCUMENTS

| | | | |
|---|---|---|---|
| 838569 | 5/1952 | Fed. Rep. of Germany . | |
| 2841635 | 4/1980 | Fed. Rep. of Germany | 215/228 |
| 1112358 | 11/1955 | France | 215/334 |
| 2376798 | 9/1978 | France | 215/334 |
| 2496584 | 6/1982 | France . | |
| 1043038 | 9/1966 | United Kingdom . | |

*Primary Examiner*—Donald F. Norton

*Attorney, Agent, or Firm*—Michael J. Striker

[57] ABSTRACT

A bottle for containing a multi-phase liquid product has a bottle member with a main bottle wall and a lower bottle wall forming a neck with an opening, and a closure member having a central closure wall which engages and supports the neck and an outer closure wall which is in an end-to-end abutting relationship with the main wall of the bottle member and supports the main wall.

6 Claims, 2 Drawing Figures

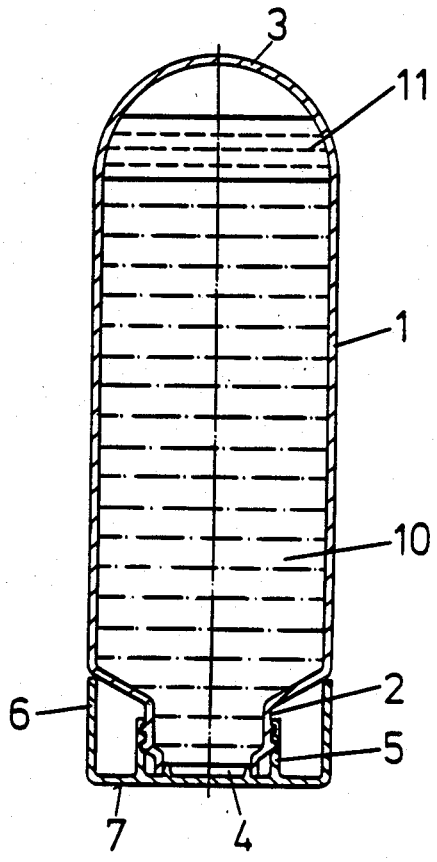
Fig. 1
FIG. 2
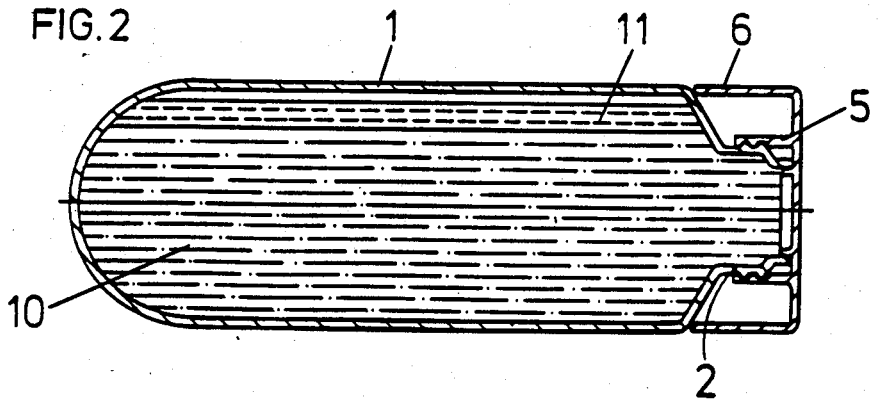

BOTTLE WITH SUPPORTING CLOSURE

TECHNICAL FIELD

This invention relates to bottles for multi-phase liquid products.

BACKGROUND ART

For cosmetic purposes it is known to use two-phase liquid products. for example hair setting lotion or products similar to setting lotion with a so-called top admixture. The top admixture consists of isoparaffins as the second phase. These are liquids which are highly volatile at room temperature and even more so at higher temperature, so that a sealed packing involves great difficulties. In addition isoparaffins have an extremely high leakage capacity. They have a low density and therefore always float on top in a two-phase mixture.

If these liquid products are bottled in conventional bottles, then considerable losses in top admixture arise as a result of diffusion and leakage in the region of the closure. For economic reasons, the closure caps of the bottles are provided with integrated sealing elements. in which case it is not possible to avoid capillaries and microscopic gaps between the neck of the bottle and the sealing element. The seals which on account of economic and functional requirements are mostly manufactured from polyolefins, only have a low diffusion density with respect to isoparaffins.

DISCLOSURE OF INVENTION

The object of the invention is therefore to design the closure for multi-phase liquid products in such a manner that liquid losses as a result of diffusion and leakage are avoided. According to the invention, this is achieved in an advantageous manner in that, in bottles filled with multi-phase liquid products, the bottle closure is designed as a base and the bottle is shaped such that it cannot stand with its opening facing upwards.

In bottles designed in accordance with the invention, the highly volatile top admixture having a lower density is isolated in a part of the bottle remote from the opening, so that the highly volatile liquid is not in the opening/closure region and losses during storage are thereby avoided. This therefore prevents both a visible drop in the filling level and an actual loss of effectiveness of the entire product. The bottle and the closure can be manufactured economically and there is no need for expensive sealing, which would also result in awkward handling.

In a preferred embodiment a screw or clamping closure extends over the neck of the bottle. In order that the bottle may also be stored on its side, it is expedient to provide the latter with at least one lateral bearing surface.

BRIEF DESCRIPTION OF DRAWINGS

The invention will be described further, by way of example, with reference to the accompanying drawings, in which:

FIG. 1 shows a bottle in longitudinal section, standing on its closure; and

FIG. 2 shows the bottle according to FIG. 1 lying on its side.

BEST MODE FOR CARRYING OUT THE INVENTION

The bottle 1 illustrated has a neck 2 and a base 3 which is curved outwards and which prevents the bottle 1 standing with the opening 4 facing upwards. A closure cap 5 is screwed or clamped onto the neck 2 of the bottle, extends laterally over the neck 2 of the bottle, and has an outer ring 6. The outer ring 6 has approximately the same diameter as the bottle 1, so that there is a base 7 which corresponds to or is larger than the diameter of the bottle. As can be seen from the drawing, the outer ring 6 of the closure cap 5 is in an end-to-end abutting relationship with the main wall of the bottle 1. Therefore, in the position shown in FIG. 1 not only the central ring of the closure cap 5 supports the neck 2 of the bottle 1, but also the outer ring 6 of the closure cap 5 supports the main wall of a bottle 1. The bottle may be provided with one or more lateral bearing surfaces so that it can also be stored lying on its side (FIG. 2).

As can be seen from the two Figures, the highly volatile top admixture 11 of isoparaffins, which floats on top of the liquid, is not in the immediate region of the bottle closure, both in the standing position according to FIG. 1 and the position according to FIG. 2 where the bottle is on its side, so that storage losses of top-admixture as a result of diffusion and leakage cannot arise.

It is understood that the invention is by no means limited to the embodiment represented in the drawings and described above, since there are many possiblities of modification to the design of the bottle according to the invention and its closure, without departing from the scope of the invention.

We claim:

1. A bottle for containing a multi-phase liquid product, comprising a bottle member having a predetermined height, said bottle member including an upper transverse bottle wall which is at least partially curved upwardly so that said bottle member cannot stand on said upper transverse bottle wall, a substantially vertical main bottle wall extending over a greater part of said height of said bottle member and having a predetermined transverse size and a lower bottle wall having a transverse size which is smaller than said predetermined transverse size of said main bottle wall and forming a neck with an opening; and a closure member having a transverse bottom closure wall, and two vertical closure walls including a central vertical closure wall having a transverse size which substantially corresponds to said transverse size of said lower bottle wall so as to close said neck with said opening, and an outer vertical closure wall having a transverse size substantially corresponding to said transverse size of said main bottle wall, said outer vertical closure wall having a height selected so that when said closure member is fitted onto said bottle member so as to close said opening, said vertical outer closure wall is in an end-to-end abutting relationship ship with said main bottle so that not only said vertical inner closure wall supports said lower bottle wall, but also said vertical outer closure wall supports said main bottle wall.

2. A bottle as defined in claim 1, wherein said main bottle wall has a predetermined diameter, said vertical outer closure wall being ring-shaped and having a diameter corresponding to said diameter of said main bottle wall.

3. A bottle as defined in claim 1, wherein said bottle member and said closure member are each formed as a one-piece member.

4. A bottle as defined in claim 1, wherein said closure member has a side which is opposite to said bottom closure wall and is open at said side.

5. A bottle as defined in claim 4, wherein said vertical outer closure wall is higher than said vertical inner closure wall.

6. A bottle as defined in claim 5, wherein said vertical outer and inner closure walls are concentric relative to one another.

* * * * *